United States Patent [19]

Fukuju et al.

[11] Patent Number: 4,555,104

[45] Date of Patent: Nov. 26, 1985

[54] OVERLAPPING DOCUMENT FEED APPARATUS

[75] Inventors: Osamu Fukuju, Yokohama; Yasuhiro Inagaki, Kanagawa; Katsuji Minoshima, Oiso, all of Japan

[73] Assignee: NCR Corporation, Dayton, Ohio

[21] Appl. No.: 653,812

[22] Filed: Sep. 24, 1984

[30] Foreign Application Priority Data

Sep. 30, 1983 [JP] Japan ..... 58-180964

[51] Int. Cl.[4] ..... B65H 7/02

[52] U.S. Cl. ..... 271/228; 271/259; 271/263; 271/274; 271/280; 271/902

[58] Field of Search ..... 271/225, 228, 263, 259, 271/274, 902, 280

[56] References Cited

U.S. PATENT DOCUMENTS 4,428,041 1/1984 Honkawa ..... 271/263 X 4,449,399 5/1984 Hain ..... 271/263 X

*Primary Examiner*—Richard A. Schacher

*Attorney, Agent, or Firm*—Wilbert Hawk, Jr.; Edward Dugas; Richard W. Lavin

[57] ABSTRACT

An apparatus for processing overlapped documents including a plurality of drive rollers for moving the overlapped document in a direction towards engagement with a stop member, first sensing means for detecting the overlapped condition of the documents and for disabling the operation of one of the drive rollers enabling each of the overlapped documents to engage the stop member in registry with each other and second sensing means for operating the drive rollers to move the stacked documents to a remote distribution station.

11 Claims, 5 Drawing Figures

OVERLAPPING DOCUMENT FEED APPARATUS

BACKGROUND OF THE INVENTION

The present invention relates to feeding apparatus and, more particularly, to an apparatus for feeding overlapping documents.

In recent years, there has been a trend to automate banking functions as they relate to bank customers. The Automated Teller Machines (ATM's) have been developed to provide remote banking operations without the presence of a bank teller. These machines include apparatuses for feeding legal documents from a storage area past a print station where data is printed thereon and then through a discharge outlet in the machine. One of the problems that has been encountered when feeding documents in such an arrangement is the presence of overlapping documents which are transmitted as a single document herein characterized as an overlapped document. Prior ATM's provided overlapped document detectors for detecting the presence of such overlapped documents. In one instance, the detection of the overlapped documents required the removal of such documents from the feeding station by hand. In another instance, in order to accommodate the automatic removal of overlapped documents, the guide chute through which the documents are fed has been lengthened to accommodate the oversize length of such documents. This requirement has limited the size of the ATM's that can be constructed, thereby affecting their marketing appeal. It is therefore a principal object of this invention to provide an apparatus for feeding and removing overlapping documents automatically from a document feed mechanism. It is another object of this invention to provide a compact apparatus for the feeding and removal of such overlapped documents. It is a further object of this invention to provide such an apparatus which is relatively simple in its construction and therefore low in cost.

SUMMARY OF THE INVENTION

These and other objects of the invention are fulfilled by providing an apparatus for feeding documents from a storage area which includes a first drive roller for feeding serratim a number of documents from the storage area into a section of a guide chute which extends in a direction which is slightly longer than the length of one of the documents. Mounted at one end of the section of the guide chute is a stop member for stopping the movement of the documents. Detecting means positioned adjacent the first drive roller detects the present of an overlapped document and operates a mechanism for adjusting the operating condition of a second drive roller engaging the overlapped document such that each of the individual documents of the overlapped document are moved into engagement with the stop member and into registry with each other from where the stacked documents are fed into a collection bin.

BRIEF DESCRIPTION OF THE DRAWING

The foregoing and various other objects, advantages and meritorious features of the present invention will be apparent from the following detailed descriptions and appended claims when read in conjunction with the drawings, wherein like numerals identify corresponding elements.

DESCRIPTION OF THE PREFERRED EMBODIMENT

Figure 1:
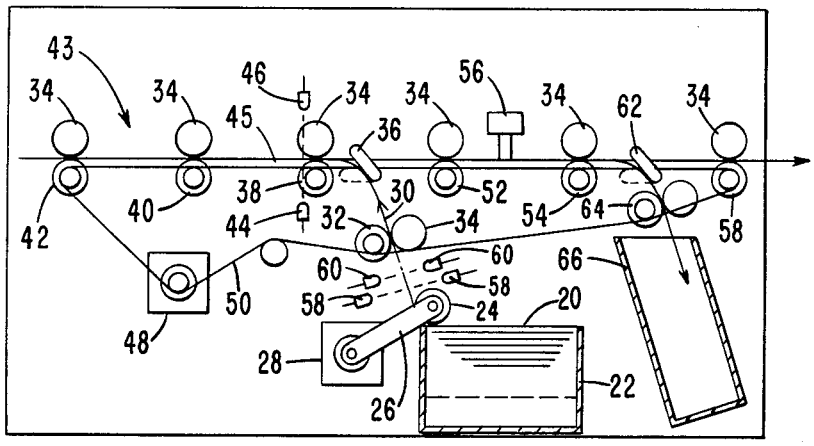
FIG. 1 PRIOR ART
FIG. 1 is a side view of a prior art overlapped document feed apparatus.

Referring now to FIG. 1, there is shown a side view of a prior art document feed apparatus commonly employed in automatic teller machines which may comprise a number of such feed apparatuses mounted in a side-by-side arrangement for feeding a document 20 from a stack of documents 21 stored in a storage bin 22. Located adjacent the storage bin 22 is a first drive roller 24 rotatably mounted on a movable arm 26 and driven in a feed direction by a motor 28 in any conventional manner for feeding the top document 20 of the stack 21 from the storage bin 22. The document 20 is moved along a pathway 30 by the feed roller 24 into engagement with a second drive roller 32, which, in cooperation with a pressure roller 34, drives the document through a movable gate member 36 and into engagement with a plurality of drive rollers 38–42 inclusive located adjacent a horizontally extending guide chute 45. The drive rollers 38–42 inclusive position the document in a document holding section of the guide chute 45 generally indicated by the numeral 43 in FIG. 1. During this movement, the drive rollers 38–42 inclusive are operated by a drive belt 50 driven in a first direction by a motor 48 which drives the document past a detection station which may comprise a light source 44 and a photodetector 46. Upon sensing the end of the document 20 the photodetector 46 generates a signal in a manner that is well known in the art to reverse the rotational operation of the motor 48 and thereby the movement of the drive belt 50 together with the feed rollers 38–42 inclusive engaged by such belt. The signal generated by the operation of the photodetector 46 also operates the gate member 36 to position the gate member in a horizontal direction as shown in dotted lines in FIG. 1.

Figure 2:
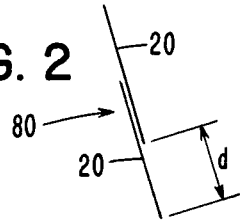
FIG. 2 is a side view of two documents in an overlapped condition showing the amount of overlap.

Reversing the direction of movement of the drive belt 50 results in the drive rollers 38–42 inclusive moving the document 20 into engagement with the drive rollers 52 and 54 which are operated by the drive belt 50 to move the document 20 to a position adjacent a print mechanism 56 where data is printed thereon and then released for movement by the feed roller 58 to discharge the document to a discharge area (not shown). When an overlapped document generally indicated by the numeral 80 (FIG. 2) comprising two or more individual documents 20 in which one overlaps the other by a distance d (FIG. 2) is removed from the storage bin 22 by the feed roller 24, a thickness detection station comprising a light source-photodetector combination 58 and a document length detector station comprising a light source-photodetector combination 60 which detects the overlapping condition of the documents 20 in a manner that is well known in the art. The overlapped document 80 (FIGS. 4 and 5) is then transported by the feed rollers 38–42 inclusive to the document holding section 43 (FIG. 1) of the guide chute 45 in the manner described previously. Since the overlapped document 80 has to move completely past the photodetector 46 in order for the document to be transported along the guide chute 45 to the print mechanism 56, the document holding section 43 is required to have a length equal to at least the length of two consecutive documents in order to accommodate an overlapped document 80. Once the trailing edge of the overlapped document 80 moves past the photodetector 46, the rotational movement of the feed rollers 38–42 inclusive are reversed by the drive belt 50 as a result of a signal generated by the photodetector 46 and the document is then transported to a gate member 62 which has been rotated into the path of the document by the control signal generated by the detectors 58 and 60. The document 80 deflected by the gate member 62 is engaged by a feed roller 64 which positions the document in a collection bin 66. It is obvious that if three or more documents are removed from the storage bin 22 in an overlapping condition forming a document whose length exceeds the length of the document checking section 43, the trailing edge of the document cannot move past the photodetector 46 resulting in a jam condition requiring that the document be removed by hand.

Figure 3:
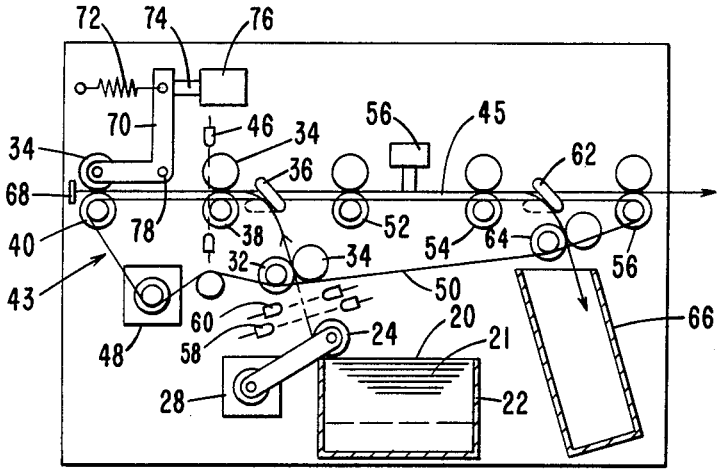
FIG. 3 is a side view of the feed apparatus of the present invention.

Referring now to FIG. 3, there is shown the present invention which has the same basic configuration as shown in FIG. 1 except that the feed roller 42 and its associated pressure roller 34 has been removed, thus shortening the document holding section 43 of the guide chute 45 to the length of one of the documents 20. Also included in the apparatus is a stop member 68 that has been located adjacent the feed roller 40 at the end of the guide chute 45, thus defining the length of the document checking section. The pressure roller 34 associated with the drive roller 40 has been mounted on one end of an L-shaped rockably mounted arm member 70 whose other end is engaged by a spring member 72 normally rocking the arm member and the pressure roller 34 in a counter-clockwise direction into engagement with the feed roller 40. Also engaging the arm member 70 is the armature member 74 operated by a solenoid 76 which is energized by signals produced by the photodetectors 58 and 60 to rotate the arm member 70 about a pivot point 78 in a clockwise direction removing the pressure roller 34 from engagement with the drive roller 40.

Figure 4:
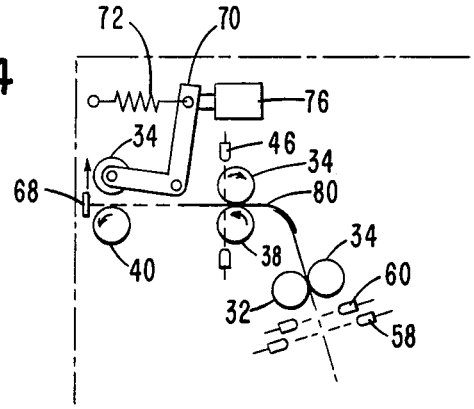
FIG. 4 is a partial side view of the feed apparatus of FIG. 3 showing the position of documents in an overlap condition prior to movement into a position engaging the stop member.
Figure 5:
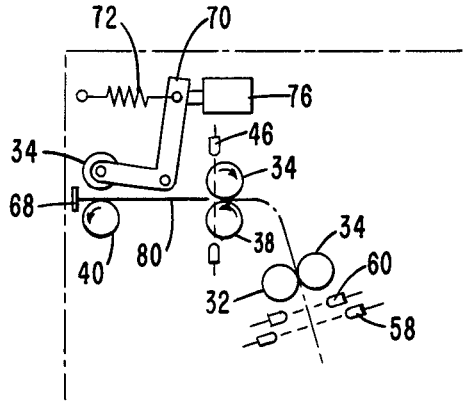
FIG. 5 is a partial side view of the feed apparatus of FIG. 3 showing the stacked position of the overlapping documents when moved against the stop member.

In the operation of the feed apparatus disclosed in FIG. 3, the movement of an overlapped document 80 (FIGS. 4 and 5) by the drive roller 24 from the stack 21 and past the thickness photodetector 58 and the length photodetector 60 results in the photodetectors 58, 60 outputting a first control signal indicating the presence of an overlapped document. This control signal will energize the solenoid 76 which rocks the arm member 70 clockwise removing the pressure roller 34 from engagement with the drive roller 40 (FIG. 4). This first control signal also rotates the gate member 62 to a blocking position in the guide chute as shown in FIG. 3. At this time, the overlapped document 80 is driven toward the stop member 68 by the drive rollers 38 and 40. As the top document 20 of the document 80 is stopped by the stop member 68, the lower document of the document 80 is engaged by the drive roller 40 which, due to the disengagement of its associated pressure roller 34, will produce a slight frictional force on the document thus allowing the document to be driven under the first document to a position engaging the stop member 68 and in registry with the first document (FIG. 5) as a result of the driving force produced by the feed rollers 38 and 40. If more than two documents are involved in this operation, the action of the feed rollers 38 and 40 allows the last document of the overlapped document 80 to be driven beneath the other documents of the document 80 to a position engaging the stop member. As the last document moves against the stop member 68, the photodetector 46 will generate a second control signal deenergizing the solenoid 76, rotating the gate member 36 to a horizontal position as shown in dotted lines in FIG. 3, and stopping the operation of the motor 48. The deenergizing of the solenoid 76 results in the spring member 72 (FIG. 3) rotating the arm member 70 in a counter-clockwise direction moving the pressure roller 34 back into engagement with the stack of aligned documents 20 located against the stop member 68. After a predetermined time period, the motor 48 is again operated in a direction reversed to its previous direction which rotates the drive rollers 38, 40, 52 and 54 in a clockwise direction driving the stack of documents into engagement with the gate member 62 which deflects the documents into the collection bin 66.

It will be seen from this construction that the apparatus is capable of processing any number of documents 20 which are fed from the storage bin 22 in an overlapped condition while providing a compact structure for the apparatus.

While the principles of the invention have now been made clear in the illustrated embodiment, it will be obvious to those skilled in the art that many modifications in structure, arrangement, elements and components can be made which are practically adapted for specific environments and operation requirements without departing from these principles. The appended claims are therefore intended to cover and embrace any such modification, within the limits only of the true spirit and scope of the invention.

We claim:

1. A document transport system for transporting documents from a stack of documents to a remote distribution station, comprising;

means for feeding a document from the stack along a feed path;

means positioned adjacent said feed path for generating a first control signal upon detecting a plurality of documents in an overlapped condition;

stop means positioned in said feed path;

oppositely positioned drive rollers positioned adjacent said feed path for driving the lead document of the overlapped document against the stop means;

means responsive to the generation of said first control signal for disabling one of said oppositely-positioned drive rollers enabling the other drive roller to move each of the remaining overlapped documents against the stop means superimposed on the lead document;

and means for feeding the superimposed documents from the stop means to a remote distribution station permitting removal of the documents from the system.

2. The transport system of claim 1 which further includes first actuating means engaging said one of said oppositely-positioned drive rollers for normally urging said one of said oppositely-positioned drive rollers into engagement with the lead document of the overlapped document for moving the lead document against the stop means.

3. The transport system of claim 2 which further includes second means positioned adjacent the feed path for generating a second control signal upon detecting the last document of the overlapped document engaging the stop means, said disabling means being connected to said second detecting means whereby the disabling means, in response to the generation of said second control signal, enables said first actuating means to urge said one of said opposite drive rollers into engagement with the lead document of the overlapped document.

4. The transport system of claim 3 in which the distance between the second detecting means and the stop means is the length of one of the documents.

5. The transport system of claim 4 in which said disabling means includes a rotatably mounted support member engaging said one of said oppositely positioned drive rollers, and second actuating means connected to said first detecting means and engaging said support member for rotating the support member in a first direction to remove said one of said oppositely positioned drive rollers from engagement with a document in said feed path in response to the generation of said first control signal.

6. A document transport system for transporting documents from a stack of documents to a remote distribution station comprising;

a storage unit for storing the stack of documents;

first feeding means for feeding a document from the storage unit to a feed path;

first sensing means positioned adjacent said storage unit for generating a first control signal upon sensing the presence of overlapped documents being fed from the storage unit;

a stop member positioned in said feed path;

second feeding means positioned adjacent said feed path for feeding the lead document of the overlapped document against the stop member, said second feeding means includes first and second oppositely positioned drive rollers engaging the lead document therebetween;

a rotatably mounted support member positioned adjacent said feed path rotatably supporting said first feed roller;

actuating means connected to said first sensing means and said support member for rotating said support member in a first direction in response to the generation of said first control signal whereby said first drive roller is removed from a position feeding the lead document against the stop member thereby enabling the second feed roller to feed each of the remaining overlapped documents against the stop member in registry with the lead document;

and third feeding means positioned adjacent said feed path feeding the documents positioned against the stop member to a remote distribution station permitting removal of the document from the system.

7. The transport system of claim 6 which further includes resilient means engaging said support member for normally urging the support member in a second direction against the action of said actuating means whereby said first drive roiler is moved into engagement with the lead document.

8. The transport system of claim 7 which further includes second sensing means positioned adjacent the feed path and said second feeding means for generating a second control signal upon sensing movement of the last document of the overlapped document against the stop member, said actuating means connected to said second sensing means whereby the actuating means is disabled from rotating said support member in a first direction enabling said resilient means to move the support member in said second direction.

9. The transport system of claim 8 in which the distance between the location of the second sensing means and the stop member is the length of one of the documents.

10. The transport system of claim 9 in which said support member comprises an L-shaped lever member having one end supporting the first drive roller and the opposite end engaged by said actuating means and said resilient means.

11. The transport system of claim 10 which further includes drive means connected to said second sensing means and operating said first, second and third feeding means for operating said feeding means in a first direction to move the documents of the overlapped document into engagement with the stop member and in a second direction for feeding the documents from the stop member to the distribution station, said drive means adapted to change the direction of operation of said feeding means from said first direction to said second direction in response to generation of said second control signal.

* * * * *